US007588524B2

(12) United States Patent
Wolff et al.

(10) Patent No.: US 7,588,524 B2
(45) Date of Patent: Sep. 15, 2009

(54) FIBER FILTER PRODUCTION

(75) Inventors: Stephan Wolff, Glinde (DE); Thorsten Scherbarth, Geesthacht (DE); Soenke Horn, Geesthacht (DE); Irene Maurer, Hamburg (DE); Alexander Buhl, Robertsdorf (DE); Jann De Boer, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 11/695,906

(22) Filed: Apr. 3, 2007

(65) Prior Publication Data

US 2007/0243985 A1 Oct. 18, 2007

(30) Foreign Application Priority Data

Apr. 18, 2006 (DE) ..... 10 2006 018 102

(51) Int. Cl.
*B31C 99/00* (2009.01)

(52) U.S. Cl. ..... 493/39; 493/50; 493/42

(58) Field of Classification Search ..... 493/39, 493/44–50, 42

See application file for complete search history.

(56) References Cited

U.S. PATENT DOCUMENTS

| | | | | |
|---|---|---|---|---|
| 2,796,810 | A | 6/1957 | Müller | |
| 4,185,644 | A | 1/1980 | Heitmann et al. | |
| 4,640,810 | A * | 2/1987 | Laursen et al. | 264/518 |
| 4,785,830 | A | 11/1988 | Möller et al. | |
| 5,858,152 | A * | 1/1999 | Nagatsuka et al. | 156/181 |
| 6,368,609 | B1 * | 4/2002 | Fontenot et al. | 424/404 |
| 6,479,061 | B2 * | 11/2002 | Fontenot et al. | 424/404 |
| 6,709,613 | B2 * | 3/2004 | Chambers et al. | 264/121 |
| 7,318,797 | B2 * | 1/2008 | Buhl et al. | 493/44 |
| 2003/0114066 | A1 * | 6/2003 | Clark et al. | 442/361 |
| 2003/0116890 | A1 * | 6/2003 | Chambers et al. | 264/518 |
| 2003/0213496 | A1 | 11/2003 | Wolff et al. | |
| 2004/0235631 | A1 | 11/2004 | Buhl et al. | |
| 2004/0237269 | A1 | 12/2004 | Arnold et al. | |
| 2004/0250823 | A1 | 12/2004 | Arnold et al. | |
| 2005/0011529 | A1 | 1/2005 | Horn et al. | |
| 2005/0224087 | A1 | 10/2005 | Draghetti et al. | |
| 2006/0010654 | A1 | 1/2006 | Buhl et al. | |

FOREIGN PATENT DOCUMENTS

| | | |
|---|---|---|
| DE | 10217410 | 10/2003 |
| EP | 1464239 | 10/2004 |
| EP | 1464241 | 10/2004 |
| EP | 1504683 | 2/2005 |
| EP | 1584248 | 10/2005 |
| EP | 1464240 | 10/2006 |
| GB | 2145918 | 4/1985 |

OTHER PUBLICATIONS

English Language Abstract of EP 1 504 683.

* cited by examiner

*Primary Examiner*—Hemant M Desai
(74) *Attorney, Agent, or Firm*—Greenblum & Bernstein, P.L.C.

(57) ABSTRACT

Method and device for producing filter rods of the tobacco-processing industry. The method includes combining and mixing fibers of finite length of two different fiber types, and separating the combined and mixed fibers. The combining and mixing occurs directly before the separating.

28 Claims, 3 Drawing Sheets

FIBER FILTER PRODUCTION

CROSS-REFERENCE TO RELATED APPLICATIONS

The present application claims priority under 35 U.S.C. §119 of German Patent Application No. DE 10 2006 018 102.6, filed on Apr. 18, 2006, the disclosure of which is expressly incorporated by reference herein in its entirety.

BACKGROUND OF THE INVENTION

1. Field of the Invention

The invention relates to a method for producing and a device for producing filter rods of the tobacco-processing industry.

2. Discussion of Background Information

A method for producing a web for the production of filters or filter rods of the tobacco-processing industry is known from commonly owned European Patent Application No. EP 1 464 241 A1. Moreover, a filter rod-making machine of the tobacco-processing industry is disclosed. The filter rod-making device comprises at least one filter material feed device from which the filter material can be transferred in metered quantities and a rod assembly device in which the filter material is poured to form a rod. The filter rod-making device known from EP 1 464 241 A1 further includes the feature that the filter material can be conveyed in a fluidized bed from the filter material feed device to the rod assembly device. The method disclosed in this document is characterized by the following process steps:

Feeding separated filter materials to a fluidized bed,

Transporting the filter material in the fluidized bed essentially by means of a transport air flow in the direction of a rod assembly device, and Pouring the filter material on the rod assembly device.

A method and a device for producing a web for the production of filter rods is known from commonly owned European Patent Application No. EP 1 464 240 A1. the method is characterized by the following process steps:

Separating fibers of at least one type of filter material in a separating device, Feeding the separated fibers to a conveyor that moves in a conveying direction, Pouring the separated fibers on the conveyor, whereby a web is formed, the separating device comprising at least one separating element that rotates about a rotational axis, the rotational axis being aligned essentially parallel to the conveying direction of the conveyor.

The device described in the preceding paragraph is characterized in that separating devices are provided which are embodied separately from one another.

The devices in the two referenced European patent applications process finite fibers so that webs, filter rods and filters are produced from finite fibers and optionally other filter constituents such as granulates.

SUMMARY OF THE INVENTION

The present invention provides an efficient variant of a filter rod-making method and a device for producing filter rods.

Accordingly, the invention provides a method for producing filter rods of the tobacco-processing industry, such that fibers of finite length, composed of two different fiber types, are combined and mixed directly before a separating step.

The method according to the invention makes it possible for a segregation of fiber materials to be avoided before the separation step. Within the scope of the invention, directly before a separating step means that mixing and combining occur without any further intermediate step to the separating step or is free from a processing step or a separating step directly follows the combining and mixing. Within the scope of the invention, in particular finite fibers from two or at least two different fiber types are processed. Preferably, the mixing occurs with the combining or begins with the combining. In particular, this also means that the mixing begins with the combining and is continued on a predetermined conveyor path.

If a step for pouring to form a fiber web takes place after the separating step, a very homogenous filter rod can be produced. The separating step preferably comprises an acceleration of the fibers, in which a very homogenous separation as well as a very homogenous filter rod can be achieved. In a particularly simple process management, the acceleration takes place in or by a teasel. Within the scope of the invention, teasel also means a carding device or a part of a carding device or a card. In particular, a teasel is also understood to mean one or more rollers that are embodied on the circumferential surface in a similar manner to a natural teasel. These can also be embodied with sawtooth or trapezoid-tooth assemblies. Correspondingly, fine carded rollers can also be present.

Preferably, the fibers of two different fiber types are brought together unmixed before the step of combining and mixing. Within the scope of the invention the term unmixed means in particular homogenous. If the fibers are accumulated unmixed before being combined, a particularly good metering of the fibers is possible. They can then subsequently first be preseparated or separated, are then combined and mixed and subsequently separated again in order to be able to produce homogenous filter rods. An accumulation of the fiber mixture can also be provided before the final separating step.

A particularly preferred embodiment is given if the combined fibers are conveyed to a separating device by a transport air flow. The conveyance by a transport air flow preferably occurs in the area of the intermixing of the fibers. However, this can also already take place shortly before the combination of the different fiber types or directly before it.

A particularly efficient embodiment of the separating device is given if it comprises several rolls arranged one behind the other, the rotational speeds of which increase in the fiber conveying direction. A separation can thus be carried out very efficiently which prevents a segregation of the fibers.

The invention is directed to a method for producing filter rods of the tobacco-processing industry comprising fibers of finite length of at least one fiber type that preferably comprises the foregoing process steps at least in part. In this regard, a step of separating the fibers in a separating device is provided, such that the separated fibers that exit from the separating device have a component motion in the direction of a conveyor, in particular a suction rod conveyor, in particular against gravity. It is hereby possible for the amount of air flow that is required in the prior art, e.g., according to EP 1 464 241 A1, to be considerably reduced and also for less air to have to be removed from the method process which makes it possible to simplify process management.

The separated fibers are preferably flung into a suction duct directly from the separating device. Preferably, the suction rod conveyor is connected to the suction duct, and namely in particular directly, so that the fibers need to cover a very short distance after the separating device in order to be poured in the suction rod conveyor, e.g., on one or more suction belts.

In a preferred embodiment in the conveying direction downstream of the separating device the fibers are mixed with another filter material, such as, e.g., a granulate from activated charcoal and/or binder that has a component motion in the direction of a suction rod conveyor, in particular against gravity. This produces in particular a good intermixing of the fibers with the other filter material as well as the possibility of transport with as little suction air or transport air as possible If two suction ducts arranged next to one another or a division of one suction duct into two partial suction ducts arranged next to one another are provided, two filter rods can be produced simultaneously so that the throughput or the production quantity of filter rods can be increased. The suction ducts are hereby preferably essentially parallel and have an angle to one another between 0° and 15°.

Further, the invention provides a device for producing filter rods of the tobacco-processing industry with at least two fiber feed ducts that open into a duct. A separating device is connected to the one duct, and a conveyor, in particular, a suction rod conveyor, is provided onto which the separated fibers of finite length can be poured. In particular, hereby the one duct and the separating device lie directly one behind the other in the conveying direction of the fibers or adjacent to one another. The device according to the invention renders possible a particularly simple intermixing of different fiber types, such that a segregation in the further process or in the further processing of the fiber mixture is avoided. Furthermore, a very compact device is rendered possible.

Preferably, a device is provided for generating an air flow in the one duct, which device is suitable in particular for conveying the fiber mixture. Furthermore, the provision of a device for generating an air flow in the one duct, which can preferably be a ventilator that drives through the one duct, renders possible a very efficient mixing of the material. To this end, for example, the ventilator can have one or more ventilator impeller wheels through which the fibers pass, whereby a rotation component is fed to the fiber mixture, which renders possible a very good intermixing.

If a retaining duct is respectively connected upstream of the at least two fiber feed ducts or is contained in the at least two fiber feed ducts, a very homogenous fiber mixture as well as a very good preliminary metering is possible.

Preferably, the one duct is embodied as a retaining duct. The variant in which a ventilator drives through the one duct means in particular that the ventilator is integrated into the duct.

The separating device preferably comprises several rolls arranged one behind the other, the rotational speeds of which increase in the fiber conveying direction. Preferably, at least one roll is embodied in a teasel-like manner. To this end the roll preferably has on the circumferential surface a structure like a natural teasel, i.e., in particular prongs or pins lying close together. The roll can also be embodied on the circumferential surface in the form of sawteeth or trapezoid teeth. The assemblies of the rolls lying one behind the other can be embodied to be progressively finer in the fiber conveying direction, so that fibers that are transported by rolls lying one behind the other are subjected to a longitudinal alignment, parallelization and separation.

Preferably, a suction duct is directly connected to the separating device, which suction duct is aligned vertically and terminates with a suction rod conveyor. A device with a very compact design is thus possible. Preferably, the suction rod conveyor is arranged at the upper end of the suction duct, which results in a very uniform fiber web formation in the suction rod conveyor so that very homogenous filter rods can be produced. Preferably, two suction rod conveyors or two suction belts are provided in a suction rod conveyor in order to render possible a very high throughput and a high production quantity of filter rods.

If two suction ducts are provided, or one suction duct is divided into two ducts in the fiber conveying direction shortly before the suction rod conveyors or the suction rod conveyor with two suction belts, a uniform distribution of the fibers is possible.

A uniform distribution of the quantities of fibers that are taken up by the suction belts or the suction rod conveyors can take place, e.g., by adjusting the air flow or the suction air flow through the respective suction belts or suction rod conveyors.

The present invention is directed to a method for producing filter rods of the tobacco-processing industry. The method includes combining and mixing fibers of finite length of two different fiber types, and separating the combined and mixed fibers. The combining and mixing occurs directly before the separating.

According to a feature of the invention, the mixing can occur with the combining.

In accordance with another feature of the instant invention, after the separating, the method can further include forming a fiber web.

According to still another feature, the separation can include accelerating the fibers. The accelerating of fibers may occur in or by a teasel.

The fibers of two different fiber types may be unmixed before the combining and mixing. The method can further include accumulating the unmixed fibers before the combining and mixing.

Moreover, the method can include conveying the combined fibers to a separating device by a transport air flow. The separating device may include several rolls arranged one behind the other, the rotational speeds of which increase in the fiber conveying direction.

In accordance with another feature of the invention, the combining and mixing can include forming a compact fiber cake at an entrance to a separating device. Further, the separating may include loosening the fibers of the compact fiber cake.

The invention is directed to a method for producing filter rods of the tobacco-processing industry. The method includes accumulating fibers of finite length of at least one fiber type, and separating the fibers in a separating device. The separated fibers exiting the separating device have a motion component in a direction of a conveyor.

In accordance with a feature of the invention, the motion component can be against gravity.

According to another feature of the present invention, the conveyor can be a suction rod conveyor.

Further, the method can include flinging the separated fibers into a suction duct directly from the separating device. The conveyor may be connected to the suction duct.

In accordance with a further feature of the instant invention, in a conveying direction downstream of the separating device, the method can include mixing fibers with another filter material having a motion component in the direction of a conveyor. The motion component can be against gravity.

Further, the suction duct can include one of two suction ducts arranged next to one another or a division forming two partial suction ducts arranged next to one another.

The instant invention is directed to a device for producing filter rods of the tobacco-processing industry. At least two fiber feed ducts opening into a mixing duct, a separating device connected to the mixing duct, and a conveyor structured and arranged to receive separated fibers of finite length.

According to feature of the invention, the conveyor may be structured and arranged to receive separated fibers to be poured from the separating device.

In accordance with another feature of the present invention, the device can include a device for generating an air flow in the mixing duct.

The device may further include retaining ducts arranged upstream of the at least two fiber feed ducts.

According to still another feature of the instant invention, the at least two fiber feed ducts form retaining ducts.

In accordance with a further feature of the present invention, the mixing duct can be embodied as a retaining duct.

According to another feature, the device can include a ventilator drive through the mixing duct.

Further, the separating device may include several rolls arranged one behind the other, the rotational speeds of which increase in the fiber conveying direction. At least one of the several rolls may be embodied in a teasel-like manner.

In accordance with still yet another feature of the present invention, the conveyor may be a suction rod conveyor. The device can also include a suction duct connected directly to the separating device, in which the suction duct is aligned essentially vertically and terminates with the conveyor. The suction rod conveyor can be arranged at an upper end of the suction duct. Further, the suction rod conveyor may include one of: two suction rod conveyors or two suction belts. The device can also include two suction ducts. Moreover, the device may include a suction duct divided into two ducts in a fiber conveying direction upstream of the one of the two suction rod conveyors or the two suction belts.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
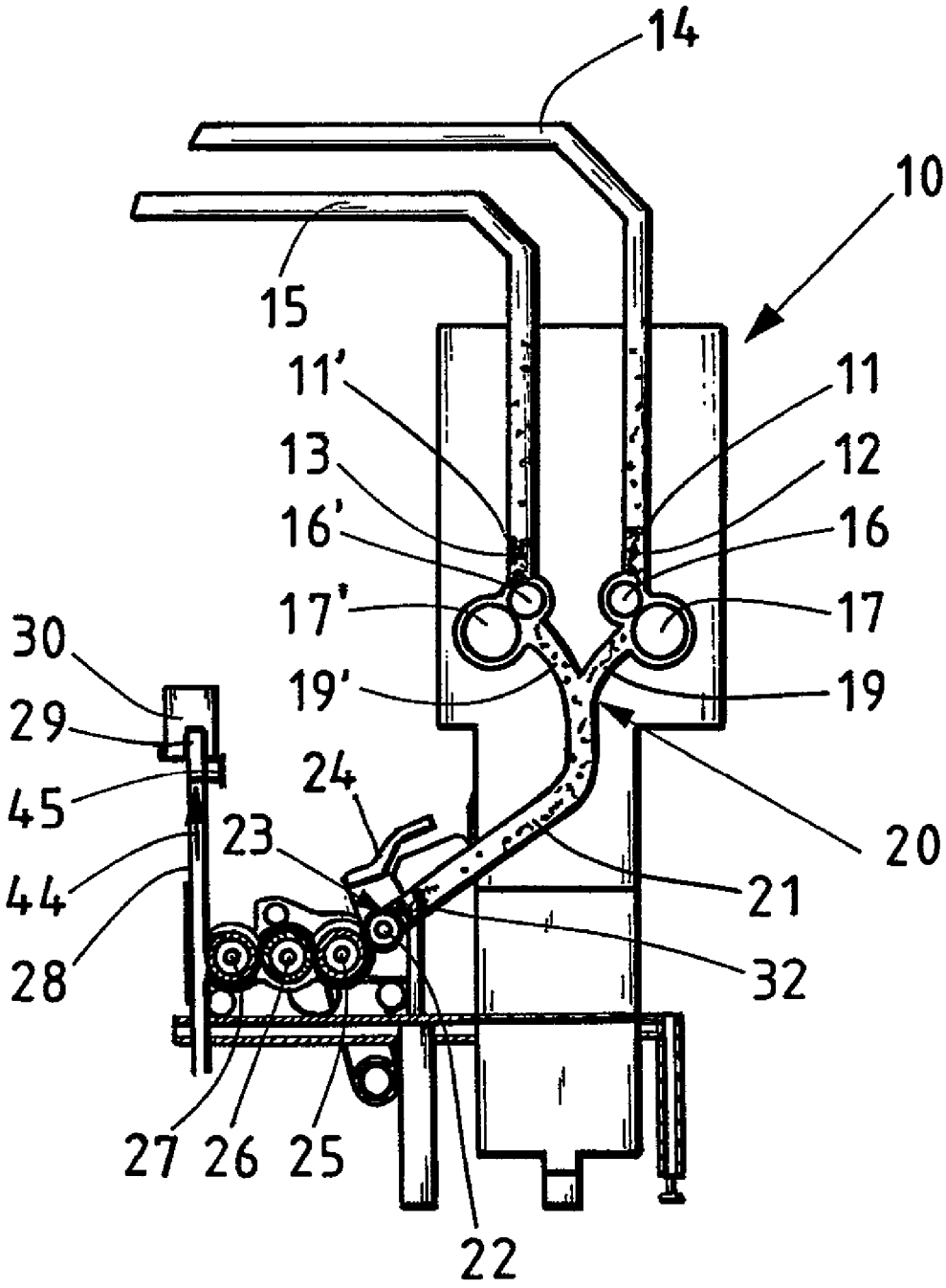
FIG. 1 is a diagrammatic sectional representation of a device according to the invention.

FIG. 1 shows a sectional representation through a device according to a first exemplary embodiment of the invention. In a fiber processing device 10, fibers 12 of a first fiber type and fibers 13 of a second fiber type are respectfully fed through a first feed pipe 14 and a second feed pipe 15 into a first retaining duct 11 and a second retaining duct 11', respectively, by, e.g., transport air. First fiber type 12 can be, e.g., a multiple-component fiber, in particular bi-component fiber, and second fiber type 13 can be fibers of cellulose acetate, cellulose or carbon fibers. Diverse fiber materials that have a finite length can be provided. With regard to the different fiber materials reference is made to the commonly owned German Patent Application No. DE 102 17 410.5, the disclosure of which is expressly incorporated by reference herein in its entirety. The length of the fibers can preferably be smaller than the length of the filter rod to be produced. Accordingly, this can be between 0.1 mm and 60 mm and, in particular, preferably between 0.2 mm and 10 mm. With fibers produced synthetically, the fiber thickness should be 1 to 20 dtex, preferably 2 to 6 dtex. The average fiber diameter can be in the range of preferably 10 to 40 μm, in particular, 20 to 38 μm and, in particular, preferably between 30 and 35 μm. The fibers are preferably curled, in particular, zigzag shaped, and have 10 arches per 10 mm.

Fibers 12 or 13 are removed from the accumulation area of the fibers of the retaining ducts 11 and 11' by intake rolls 16 and 16' and beaten out with a beater roll 17 or 17' and transferred into first fiber feed duct 19 or second fiber feed duct 19'. The different fiber types 12 or 13 are combined to form a fiber mixture 32 in a combining region 20. Fiber mixture 32 reaches a conveyor duct 21 and can accumulate shortly before intake roll 22 of a carding device or a part of a carding device.

The metering of fiber types 12 and 13 takes place through, e.g., the control of the removal speeds of the fibers by intake rolls 16, 16' and/or beater roll 17, 17'. Intake rolls 16, 16' can be embodied to run slowly, such that they convey the fibers against a spring-mounted groove (not shown). The fibers are hereby drawn in and compressed into a thin compact fiber cake (not shown).

The fiber cake conveyed downwards between intake rolls 16, 16' and groove is subsequently trimmed off or beaten out at the lower end of the groove by respectively one rapidly running beater roll 17, 17'. The fibers are thereby loosened, separated and carried into ducts 19, 19'. A supporting air flow can be used hereby, which is not shown in FIG. 1. At the end of the conveyor duct 21, the fiber mixture is gathered by intake roll 22 and conveyed against groove 23 and subsequently a leaf-spring battery 24. Groove 23 is spring-mounted. A thin, compact fiber cake is produced (not shown) and conveyed between intake roll 22, groove 23 and leaf-spring battery 24 and compacted.

If the fiber cake leaves the effective range of leaf-spring battery 24, it is gathered and taken on by rapidly running roll 25. Rolls 25, 26 and 27 are embodied as or with a teasel or equipped with sawtooth assemblies or trapezoid-tooth assemblies. The roll speeds increase from roll 25 to roll 27.

After the fibers of fiber mixture 32 have been held in the assembly of roll 25 for a rotation of approx. 180°, fibers 32 are transferred tangentially to counter-rotating roll 26. Since roll 26 rotates more quickly than roll 25 and in particular has a finer teasel structure or a finer sawtooth assembly or trapezoid-tooth assembly, a longitudinal alignment, parallelization and separation of the fibers takes place during the transfer.

After fibers 32 have been held on the circumference in the assembly of roll 26 for approx. 180°, fibers 32 are transferred tangentially in turn to counter-rotating roll 27. Since roll 27 rotates more quickly than roll 26 and has, in particular, a finer teasel-like structure or a finer sawtooth assembly or trapezoid-tooth assembly, a longitudinal alignment, parallelization and separation of the fibers again takes place during the transfer. After fibers 32 have been held in the assembly of roll 27 for 180°, fibers 32 are transferred tangentially upwards into an air flow 44 of the channel or suction duct 28. Subsequently, fiber mixture 32 reaches a suction belt 29 of a suction rod conveyor 30. Air flow 44 can additionally be separated from the fiber mixture or fiber/granulate mixture via a lateral suctioning 45 (or 45' in FIG. 4) before suction rod conveyor 30.

A conventional rod-forming device, such as, e.g., according to FIG. 10 of European Patent Application No. EP 1 464 241 A1, is connected to the suction rod conveyor, which is not shown in the figure. In this regard, the disclosure of EP 1 464 241 A1 is incorporated by reference herein in its entirety. After a fiber cake has been produced on suction belt 29 of suction rod conveyor 30, the fiber cake is usually trimmed, fed to a forming device in order to produce a fiber rod with the desired cross-sectional geometry from the fibers forming from which the fiber cake or fiber web is formed and optionally to wrap the fiber rod with a wrapping material in order subsequently to be cut to length in filter rods.

Instead of a direct injection of fibers 32 into suction duct 28, fibers 32 can be dropped first onto an endless apron and subsequently suctioned into a suction duct according to EP 1 584 248 A1, such that, preferably, one roll more or one roll less is then used in the carding device.

Figure 2:
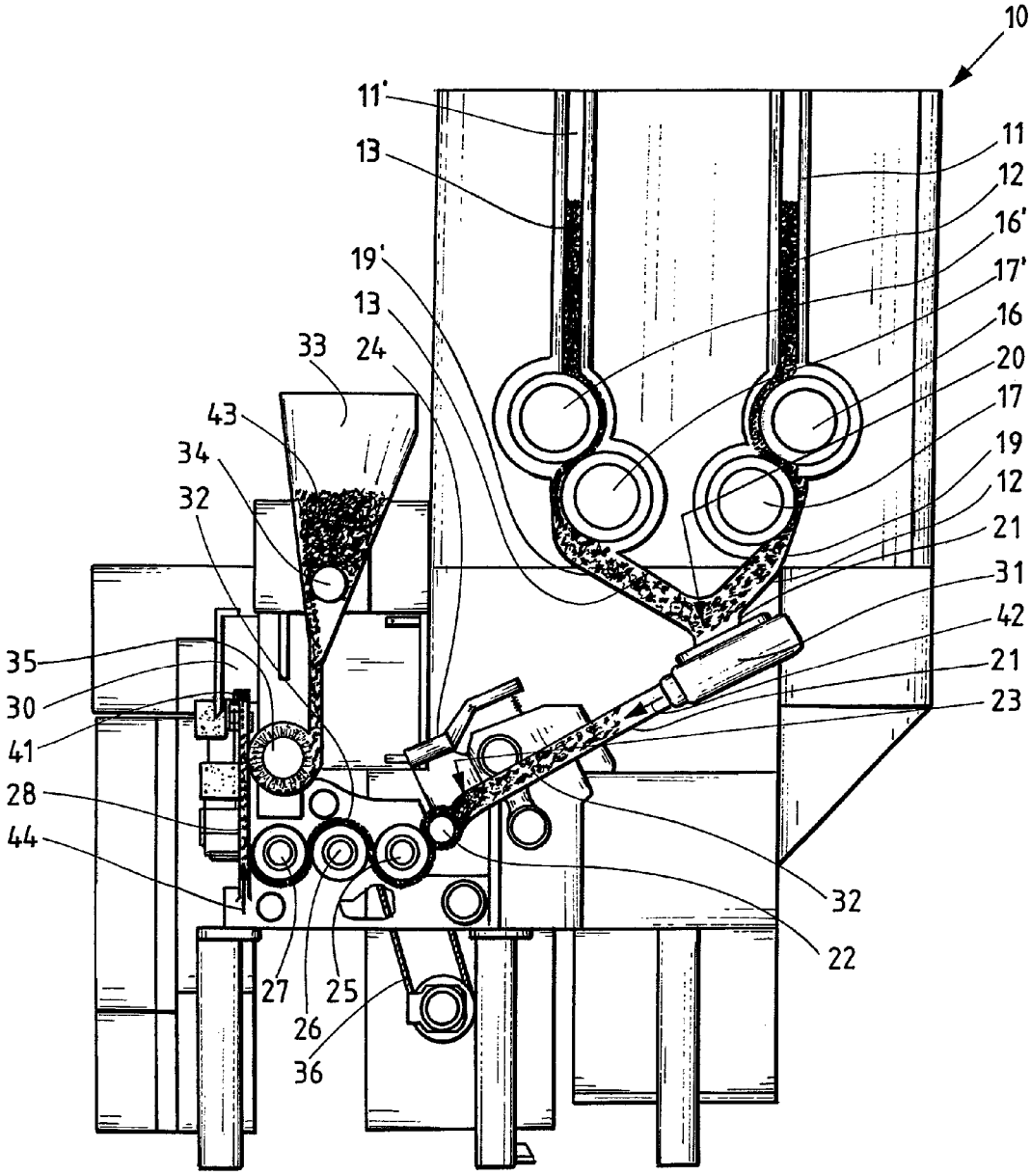
FIG. 2 is a diagrammatic sectional representation of a device according to the invention in another embodiment.

FIG. 2 shows another embodiment according to the invention of a device for producing filter rods, such that, compared to FIG. 1, a ventilator 31 is provided directly following combining area 20. Ventilator 31 generates a transport air flow 42 in conveyor duct 21. Measures can be provided to ensure a closed circulation of the transport air flow such that, e.g., in the lower area of conveyor duct 21 transport air openings are provided, which ensure that transport air is removed from conveyor duct 21 without carrying along fibers, in order then to be fed to the ventilator again.

In FIG. 2, furthermore, a drive belt 36 is provided, which, e.g., indicates a drive of roll 25. Rolls 25 through 27 as well as the other rolls used, however, can also be driven with a direct drive by one motor each.

In contrast to the exemplary embodiment according to FIG. 1, FIG. 2 depicts yet another option, namely feeding a granulate 43 to the fiber mixture. This takes place shortly before the filter material is poured onto a suction belt of a suction rod conveyor 30 in suction duct 28.

To this end, granulate 43 is fed from a granulate container 33 to a drop duct with a metering roll 34. The drop duct ends in a chamber with an accelerating roll 35 that flings the granulate tangentially in the direction of suction rod conveyor 30 into suction duct 28. A good intermixing of the granulate with the fibers thus occurs. A fiber web 41 or a filter material web 41 then forms on a suction belt of the suction rod conveyor 30.

Figure 4:
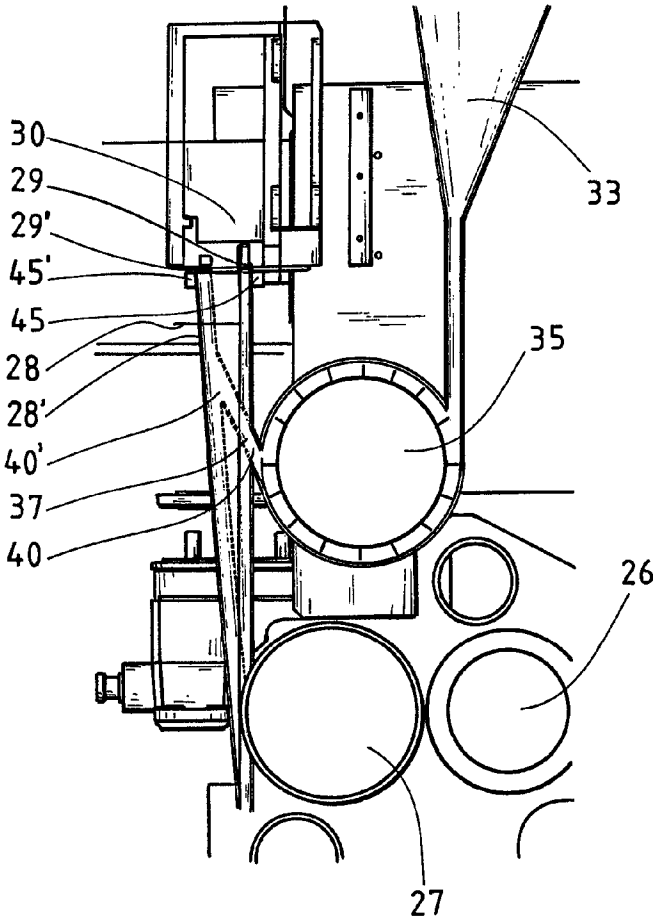
FIG. 4 illustrates a section from a device according to the invention in yet another embodiment in diagrammatic representation.
Figure 3:
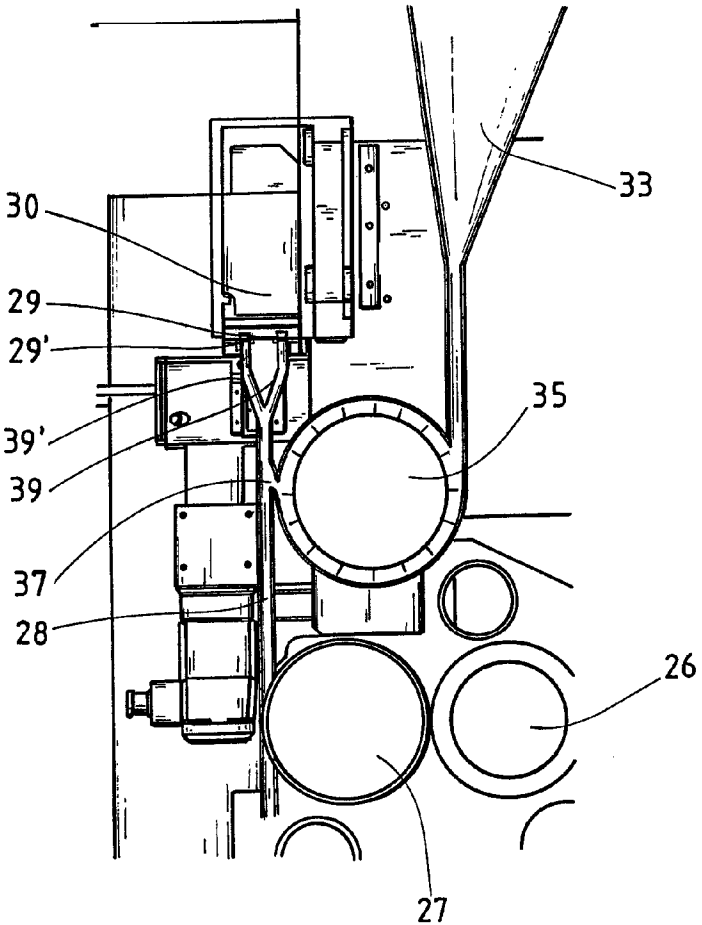
FIG. 3 illustrates a section from a device according to the invention in another embodiment in diagrammatic representation.

In order to render possible a higher production speed or a higher throughput of material and to increase the number of filter rods per unit of time, it is possible to provide two suction belts 29, 29', as indicated in FIG. 3 and FIG. 4.

To this end, as indicated in FIG. 3, a suction duct 28 can be divided into two partial ducts 39 and 39', which are arranged to run essentially parallel each other shortly before suction belts 29, 29' of suction rod conveyor 30. In FIG. 3, furthermore, injection area 37 for granulate is provided.

According to FIG. 4, two complete suction ducts 28, 28' are provided that are slightly tilted with respect to one another, in this case at an angle of approx. 3°. Suction ducts 28 and 28' can be embodied such that they are arranged one behind the other perpendicular to the drawing plane relative to the drawing plane of FIG. 4 so that respectively half the depth or width of rolls 27 or 35 are provided to respectively supply conveyor ducts 28 or 28' with filter material. Injection area 37 is then provided with a relatively short granulate duct 40 for front conveyor duct 28 relative to the drawing plane of FIG. 4 and with rear conveyor duct 28' relative to the drawing plane of FIG. 4 with a somewhat longer granulate duct 40'. Accelerator roll 35 can be embodied as a type of brush roll. The granulate is flung into the respective suction duct by centrifugal force and mixes with the fiber stream. It is preferred if the speeds of the mass stream and the granulate fed in are different relative to one another. A good mixture is hereby produced.

Through the structure according to the invention the size of the rod-maker (rod-making machine) for filter production is considerably reduced, since a suction rod conveyor can be arranged directly at the separating device. Moreover, the air consumption is reduced, since the transport stream and mixing process in an otherwise conventional long channel are omitted.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Fiber processing device
11, 11' Retaining duct
12 First fiber type
13 Second fiber type
14 First feed pipe
15 Second feed pipe
16, 16' Intake roll
17, 17' Beater roll
19 First fiber feed duct
19' Second fiber feed duct
20 Combining area
21 Conveyor duct
22 Intake roll
23 Groove
24 Leaf-spring battery
25 Roll
26 Roll
27 Roll
28, 28' Suction duct
29, 29' Suction belt
30 Suction rod conveyor
31 Ventilator

32 Fiber mixture
33 Granulate container
34 Metering roll
35 Accelerator roll
36 Drive belt
37 Injection area
38 Forking
39, 39' Partial duct
40, 40' Granulate duct
41 Fiber web
42 Transport air
43 Granulate
44 Conveying direction
45, 45' Suctioning

What is claimed:

1. A method for producing filter rods of the tobacco-processing industry, comprising:

combining and mixing fibers of finite length of two different fiber types;

separating the combined and mixed fibers in a separating device, wherein the combining and mixing occurs directly before the separating; and flinging the separated fibers into a suction duct that is directly connected to the separating device and that is vertically arranged with an upper end terminating at a suction rod conveyor.

2. The method in accordance with claim 1, wherein the mixing occurs with the combining.

3. The method in accordance with claim 1, wherein, after the separating, the method further comprises forming a fiber web.

4. The method in accordance with claim 1, wherein the separation comprises accelerating the fibers.

5. The method in accordance with claim 4, wherein the accelerating of fibers occurs in or by a teasel.

6. The method in accordance with claim 1, wherein the fibers of two different fiber types are unmixed before the combining and mixing.

7. The method in accordance with claim 6, further comprising accumulating the unmixed fibers before the combining and mixing.

8. The method in accordance with claim 1, further comprising conveying the combined fibers to a separating device by a transport air flow.

9. The method in accordance with claim 8, wherein the separating device comprises several rolls arranged one behind the other, and wherein rotational speeds of the several rolls increase in the fiber conveying direction.

10. The method in accordance with claim 1, wherein the combining and mixing comprises forming a compact fiber cake at an entrance to a separating device.

11. The method in accordance with claim 10, wherein the separating comprises loosening the fibers of the compact fiber cake.

12. A method for producing filter rods of the tobacco-processing industry comprising:

accumulating fibers of finite length of at least one fiber type;

separating the fibers in a separating device; and flinging the separated fibers exiting the separating device into a suction duct that is directly connected to the separating device and that is vertically arranged with an upper end terminating at the suction rod conveyor, whereby the separated fibers exiting the separating device have a motion component against gravity toward the suction rod conveyor.

13. The method in accordance with claim 12, wherein the conveyor is connected to the suction duct.

14. The method in accordance with claim 12, wherein, in a conveying direction downstream of the separating device, the method further comprises mixing fibers with another filter material having a motion component in the direction toward the conveyor.

15. The method in accordance with claim 14, wherein the motion component is against gravity.

16. The method in accordance with claim 12, wherein the suction duct comprises one of two suction ducts arranged next to one another or a division forming two partial suction ducts arranged next to one another.

17. A device for producing filter rods of the tobacco-processing industry, comprising:

at least two fiber feed ducts opening into a mixing duct;

a separating device connected to the mixing duct;

a conveyor structured and arranged to receive separated fibers of finite length; and a suction duct connected directly to the separating device, wherein the suction duct is aligned essentially vertically and terminates with the conveyor, wherein the conveyor is a suction rod conveyor arranged at an upper end of the suction duct.

18. The device in accordance with claim 17, wherein the conveyor is structured and arranged to receive separated fibers to be poured from the separating device.

19. The device in accordance with claim 17, further comprising a device for generating an air flow in the mixing duct.

20. The device in accordance with claim 17, further comprising retaining ducts arranged upstream of the at least two fiber feed ducts.

21. The device in accordance with claim 17, wherein the at least two fiber feed ducts form retaining ducts.

22. The device in accordance with claim 17, wherein the mixing duct is embodied as a retaining duct.

23. The device in accordance with claim 17, further comprising a ventilator structured and arranged to drive the fibers through the mixing duct.

24. The device in accordance with claim 17, wherein the separating device comprises several rolls arranged one behind the other, and wherein rotational speeds of the several rolls increase in the fiber conveying direction.

25. The device in accordance with claim 24, wherein at least one of the several rolls is embodied in a teasel-like manner.

26. The device in accordance with claim 17, wherein the suction rod conveyor comprises one of: two suction rod conveyors or two suction belts.

27. The device in accordance with claim 26, further comprising two suction ducts.

28. The device in accordance with claim 26, further comprising a suction duct divided into two ducts in a fiber conveying direction upstream of the one of the two suction rod conveyors or the two suction belts.

* * * * *